US006045108A

United States Patent [19]

Cziraky

[11] Patent Number: 6,045,108

[45] Date of Patent: Apr. 4, 2000

[54] INCLINED ADJUSTABLE EASEL WITH SLIDABLY DRAWER

[75] Inventor: David A. Cziraky, Bethlehem, Pa.

[73] Assignee: Binney & Smith Inc., Easton, Pa.

[21] Appl. No.: 09/201,567

[22] Filed: Nov. 30, 1998

[51] Int. Cl.[7] ..... A47G 1/24

[52] U.S. Cl. ..... 248/454; 312/233; 248/461

[58] Field of Search ..... 248/447, 454, 248/455, 456, 460, 461, 452; 312/233, 231

[56] References Cited

U.S. PATENT DOCUMENTS

| | | | |
|---|---|---|---|
| D. 90,769 | 9/1933 | Kamen . | |
| D. 130,591 | 12/1941 | Oesterreicher . | |
| D. 153,339 | 4/1949 | Deckinger | D74/1 |
| D. 252,758 | 8/1979 | Prall | D19/62 |
| 274,629 | 3/1883 | Merrill . | |
| D. 279,489 | 7/1985 | Mak | D21/59 |
| D. 280,649 | 9/1985 | Iwabuchi | D21/64 |
| 281,591 | 7/1883 | Werner . | |
| D. 282,752 | 2/1986 | Olivetti | D19/26 |
| 310,481 | 1/1885 | Vail . | |
| D. 330,045 | 10/1992 | Dietterich et al. | D19/36 |
| D. 337,438 | 7/1993 | Levin | D6/311 |
| D. 343,417 | 1/1994 | Tarozzi | D19/36 |
| D. 346,287 | 4/1994 | Rosen | D6/429 |
| 384,171 | 6/1888 | Morris . | |
| 385,536 | 7/1888 | Van Wart . | |
| 396,362 | 1/1889 | Marks . | |
| 440,225 | 11/1890 | Gardner . | |
| 498,578 | 5/1893 | Schmirk . | |
| 518,544 | 4/1894 | Faint . | |
| 680,404 | 8/1901 | Woodbury et al. . | |

(List continued on next page.)

FOREIGN PATENT DOCUMENTS

| | | | |
|---|---|---|---|
| B-70066/87 | 5/1990 | Australia | A47B 97/04 |
| 3931478C1 | 4/1991 | Germany | F16B 7/00 |
| 1 396 310 | 6/1975 | United Kingdom | A47B 97/04 |

OTHER PUBLICATIONS

Five (5) photographs and copies of packaging for Crayola Activity Kit, Mix–Up Magnet Easel Case, Binney & Smith Inc. ©1997.

Four (4) photographs and copies of packaging for RoseArt Super Activity Easel, RoseArt Industries, Inc. ©1994.

Copy of packaging for Comet Easel Kit, Comet–Montrose, Ltd. ©1997.

Photocopies of the box and the assembly instructions for the Sesame Street My First Easel, Avalon Industries, Inc., Division of Craft House Corporation, Toledo, Ohio ©1984, ©1986, ©1991 Children's Television Workshop.

Eight (8) photographs of product (with drawer/tray in extended and unextended positions) and packaging and photocopy of Instruction Sheet for Activity Easel by Rose Art Industries, Inc., Orange, New Jersey ©1993.

*Primary Examiner*—Ramon O. Ramirez

*Attorney, Agent, or Firm*—Leydig, Voit & Mayer, Ltd.

[57] ABSTRACT

A multi-purpose easel is provided for use by children, artists, and the like. The inventive easel includes a lower housing portion, an upper housing portion hingedly attached to the lower housing portion for movement between a multiplicity of operating positions including a closed position and an inclined position, a stand hingedly attached to the upper housing portion for supporting the upper housing portion in the inclined position, and at least one drawer slidably installed within the lower housing portion for selective inward and outward movement with respect thereto. In the closed position, a panel section of the upper housing portion is substantially parallel to an interior surface of the lower housing portion, and the upper and lower housing portions form a portable carrying case in which supplies may be stored and transported. In the inclined position, the panel section of the upper housing portion is inclined with respect to the interior surface of the lower housing portion, and forms an inclined support surface upon which artwork and other material may be supported and displayed.

18 Claims, 12 Drawing Sheets

U.S. PATENT DOCUMENTS

| | | | |
|---|---|---|---|
| 694,446 | 3/1902 | Towle | 248/450 |
| 831,766 | 9/1906 | Bing . | |
| 978,390 | 12/1910 | Morrison . | |
| 1,208,622 | 12/1916 | Muller . | |
| 1,625,647 | 4/1927 | Gillan . | |
| 1,782,118 | 11/1930 | Cahall . | |
| 2,032,872 | 3/1936 | Friedrichs . | |
| 2,143,368 | 1/1939 | Binder . | |
| 2,445,136 | 7/1948 | Egyed . | |
| 2,504,220 | 4/1950 | Ohlandt, Sr. . | |
| 2,518,877 | 8/1950 | Gauff . | |
| 2,526,527 | 10/1950 | Zander . | |
| 2,676,777 | 4/1954 | Moushon | 248/198 |
| 2,726,460 | 12/1955 | Jecmen . | |
| 2,918,732 | 12/1959 | Ortega . | |
| 3,095,665 | 7/1963 | Killen . | |
| 3,100,573 | 8/1963 | Cox | 211/177 |
| 3,145,966 | 8/1964 | Landon | 248/464 |
| 3,168,363 | 2/1965 | Monsour | 312/231 |
| 3,201,080 | 8/1965 | Rose | 248/460 |
| 3,202,471 | 8/1965 | Wilson | 312/231 |
| 3,226,077 | 12/1965 | Killen | 248/448 |
| 3,231,230 | 1/1966 | Mueller | 248/449 |
| 3,244,450 | 4/1966 | Boutin | 297/156 |
| 3,304,045 | 2/1967 | Bethoney | 248/451 |
| 3,311,202 | 3/1967 | Schell et al. . | |
| 3,352,616 | 11/1967 | Linger | 312/231 |
| 3,368,786 | 2/1968 | Bulman | 248/455 |
| 3,370,821 | 2/1968 | Mingis | 248/452 |
| 3,467,259 | 9/1969 | Silver | 211/74 |
| 3,512,745 | 5/1970 | Gress | 248/449 |
| 3,580,653 | 5/1971 | Thomas | 248/454 X |
| 3,599,925 | 8/1971 | Dubler | 248/452 |
| 3,669,227 | 6/1972 | Alford | 190/11 |
| 3,715,097 | 2/1973 | Kalajian | 248/449 |
| 3,799,488 | 3/1974 | Sena | 248/452 |
| 3,809,354 | 5/1974 | Phifer | 248/449 |
| 3,926,398 | 12/1975 | Vincent | 248/448 |
| 3,954,314 | 5/1976 | Crawford | 312/231 |
| 3,980,267 | 9/1976 | Palmer | 248/463 |
| 4,042,203 | 8/1977 | Warkentin | 248/449 |
| 4,109,892 | 8/1978 | Hartung | 248/449 |
| 4,134,614 | 1/1979 | Fielding, Sr. | 297/156 |
| 4,150,807 | 4/1979 | Manso | 248/452 |
| 4,165,856 | 8/1979 | Wiseheart | 248/449 |
| 4,260,124 | 4/1981 | Heilman | 248/449 |
| 4,294,348 | 10/1981 | Hastings | 206/1.7 |
| 4,372,630 | 2/1983 | Fuhri | 312/231 |
| 4,427,391 | 1/1984 | Berman | 434/408 |
| 4,453,470 | 6/1984 | Capella | 108/26 |
| 4,544,123 | 10/1985 | Peacock | 248/460 |
| 4,610,414 | 9/1986 | Schuck | 248/449 |
| 4,627,592 | 12/1986 | Stillwell | 248/465 |
| 4,702,638 | 10/1987 | Zalesak | 403/403 |
| 4,714,224 | 12/1987 | Calmes | 248/465 |
| 4,717,109 | 1/1988 | Johnston | 248/441.1 |
| 4,826,125 | 5/1989 | Kelley | 248/463 |
| 4,856,749 | 8/1989 | Habermann | 248/448 |
| 4,856,856 | 8/1989 | Winstone | 248/448 |
| 4,925,147 | 5/1990 | Potter | 248/463 |
| 4,968,258 | 11/1990 | Kees | 434/370 |
| 4,971,284 | 11/1990 | Curry | 248/460 |
| 5,004,204 | 4/1991 | Cook | 248/449 |
| 5,005,795 | 4/1991 | Holmgren | 248/449 |
| 5,088,678 | 2/1992 | Bitan | 248/460 |
| 5,125,613 | 6/1992 | Albee, Jr. et al. | 248/464 |
| 5,152,490 | 10/1992 | Deutsch | 248/452 |
| 5,219,142 | 6/1993 | Potter | 248/454 |
| 5,242,145 | 9/1993 | Linnell | 248/449 |
| 5,273,248 | 12/1993 | Grander | 248/460 |
| 5,312,082 | 5/1994 | Chang | 248/452 |
| 5,337,996 | 8/1994 | Kalish | 248/460 |
| 5,393,030 | 2/1995 | Tarozzi | 248/460 |
| 5,409,383 | 4/1995 | Mannino | 434/414 |
| 5,542,640 | 8/1996 | Tarozzi | 248/460 |
| 5,607,135 | 3/1997 | Yamada | 248/456 |
| 5,651,525 | 7/1997 | Yang | 248/456 |
| 5,855,351 | 1/1999 | Cziraky et al. | 248/460 |

INCLINED ADJUSTABLE EASEL WITH SLIDABLY DRAWER

FIELD OF THE INVENTION

The present invention relates generally to equipment for children and artists and, more particularly, to a multi-purpose easel which serves as a portable carrying case in one condition, and as an inclined support surface in another condition.

BACKGROUND OF THE INVENTION

Easels for supporting and displaying artwork in an inclined condition are known in the art. In addition, receptacles for storing and transporting art supplies are also known. There are also devices which incorporate both of these features into a single assembly. Such devices, however, suffer from noted deficiencies including, for example, being difficult and time consuming to set-up, being bulky and awkward to transport, and being relatively complex and expensive in construction. For at least these reasons, such devices are generally unsuitable for children and amateur artists.

OBJECTS OF THE INVENTION

Accordingly, a general object of the present invention is to provide a multi-purpose easel which serves as a portable carrying case in one condition, and as an inclined support surface in another condition.

Another object is to provide a multi-purpose easel which serves as a portable carrying case in one condition and as an inclined support surface in another condition and which includes a drawer for storing supplies.

A further object of the present invention is to provide a multi-purpose easel which may be set-up without the use of tools or other equipment.

Another object of the present invention is to provide a multi-purpose easel which is easily transportable.

An additional object of the present invention is to provide a multi-purpose easel which is suitable for use by children and artists.

Still another object of the present invention is to provide a multi-purpose easel as characterized above which is relatively simple and economical in construction, and which lends itself to reliable operation and use.

SUMMARY OF THE INVENTION

In accordance with these and other objects, a multi-purpose easel is provided for use by children, artists, and the like. The inventive easel includes a lower housing portion, an upper housing portion hingedly attached to the lower housing portion for movement between a multiplicity of operating positions including a closed position and an inclined position, a stand hingedly attached to the upper housing portion for supporting the upper housing portion in the inclined position, and at least one drawer slidably installed within the lower housing portion for selective inward and outward movement with respect thereto. In the closed position, a panel section of the upper housing portion is substantially parallel to an interior surface of the lower housing portion, and the upper and lower housing portions form a portable carrying case in which supplies may be stored and transported. In the inclined position, the panel section of the upper housing portion is inclined with respect to the interior surface of the lower housing portion, and forms an inclined support surface upon which artwork and other material may be supported and displayed.

These and other objects, features, and advantages of the present invention will become more readily apparent upon reading the following detailed description of the illustrated embodiment, and upon reference to the accompanying drawings wherein:

Figure 1:
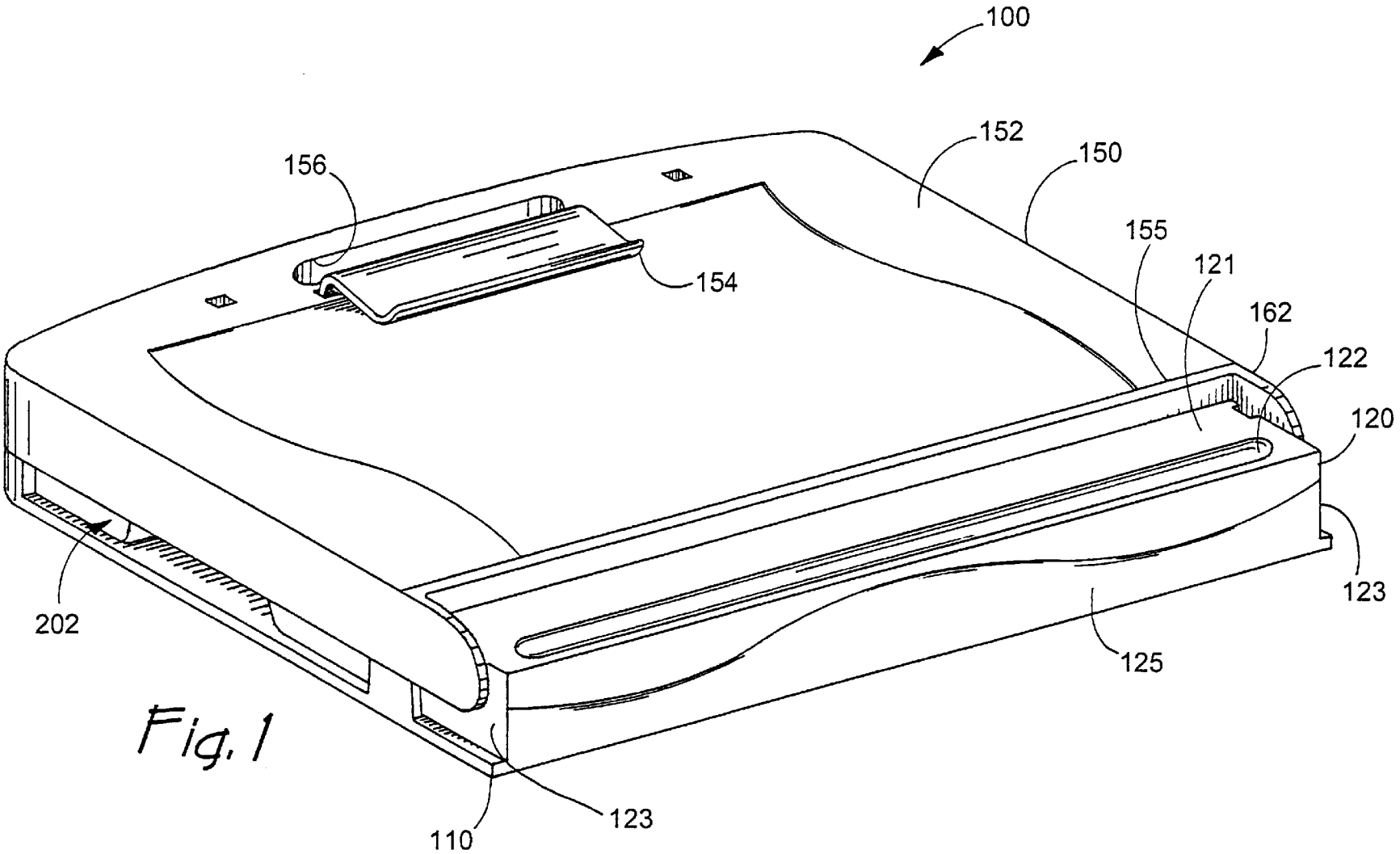
FIG. 1 is a perspective view of a multi-purpose easel constructed in accordance with the present invention.
Figure 2:
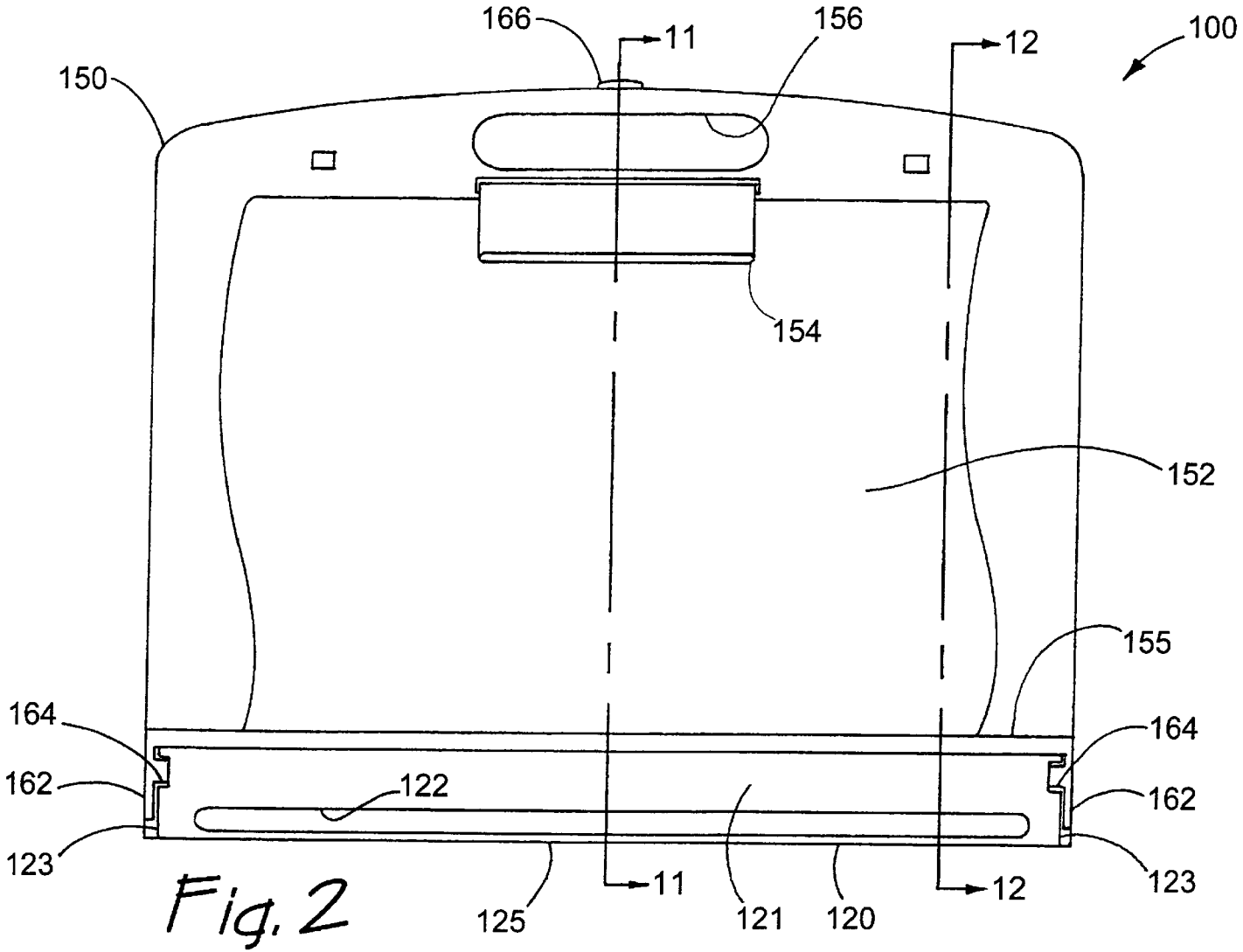
FIG. 2 is a top plan view thereof.
Figure 3:
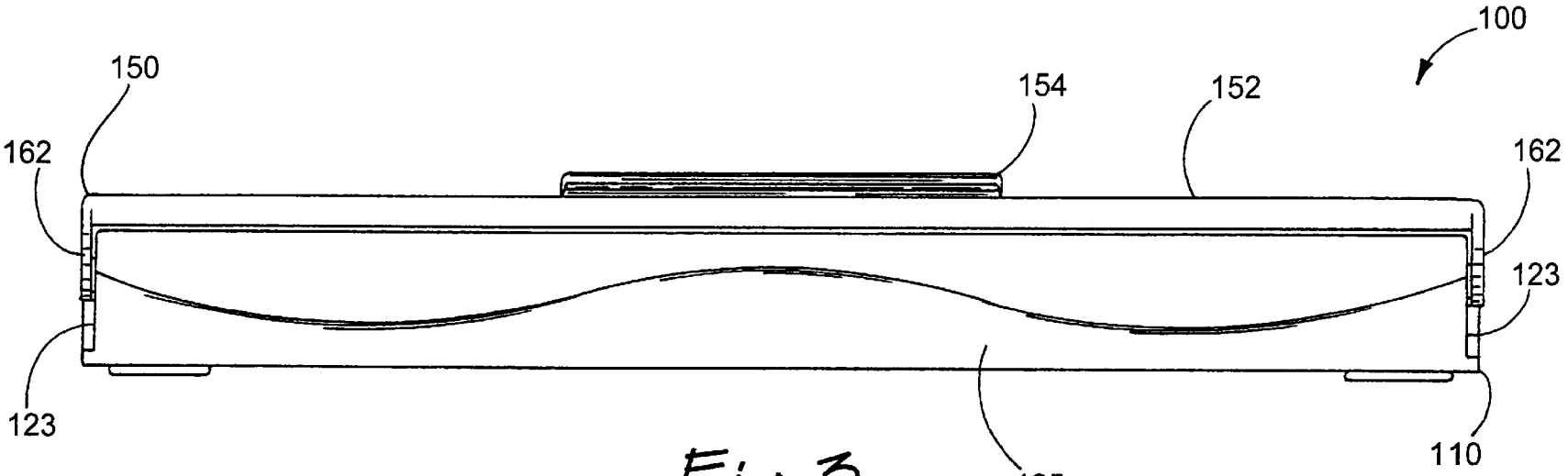
FIG. 3 is a front side elevational view thereof.
Figure 4:
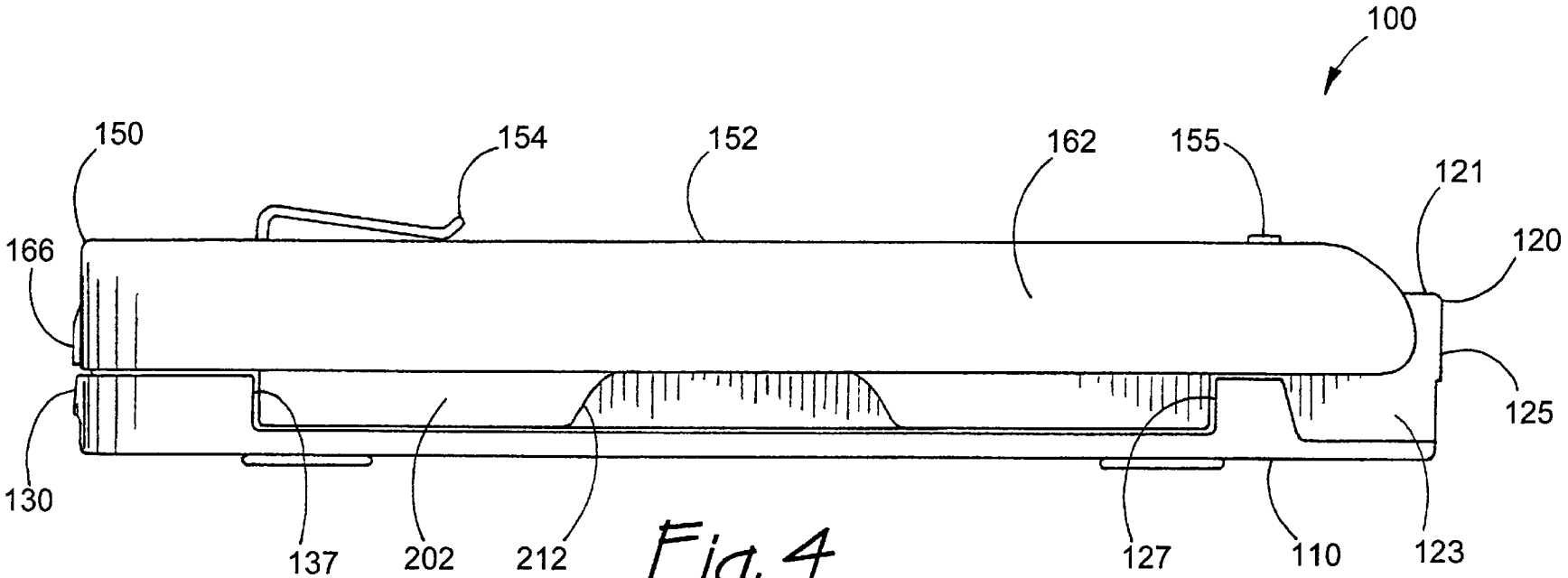
FIG. 4 left side elevational view thereof.
Figure 5:
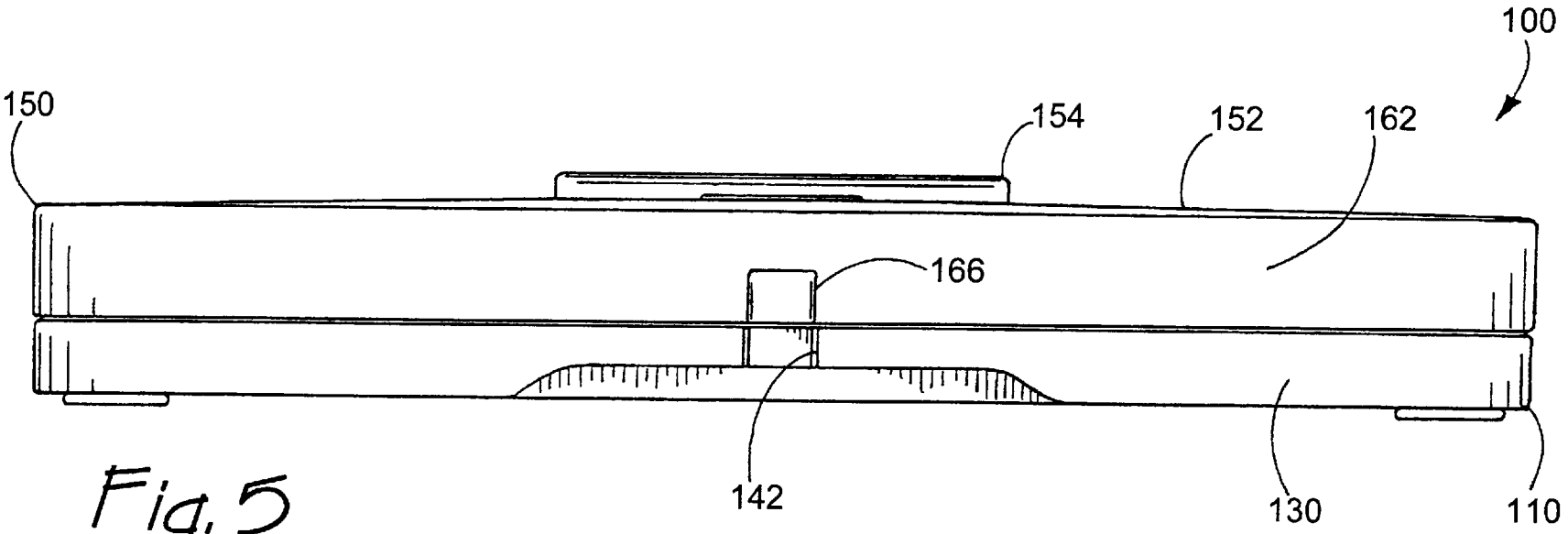
FIG. 5 is a rear side elevational view thereof.
Figure 6:
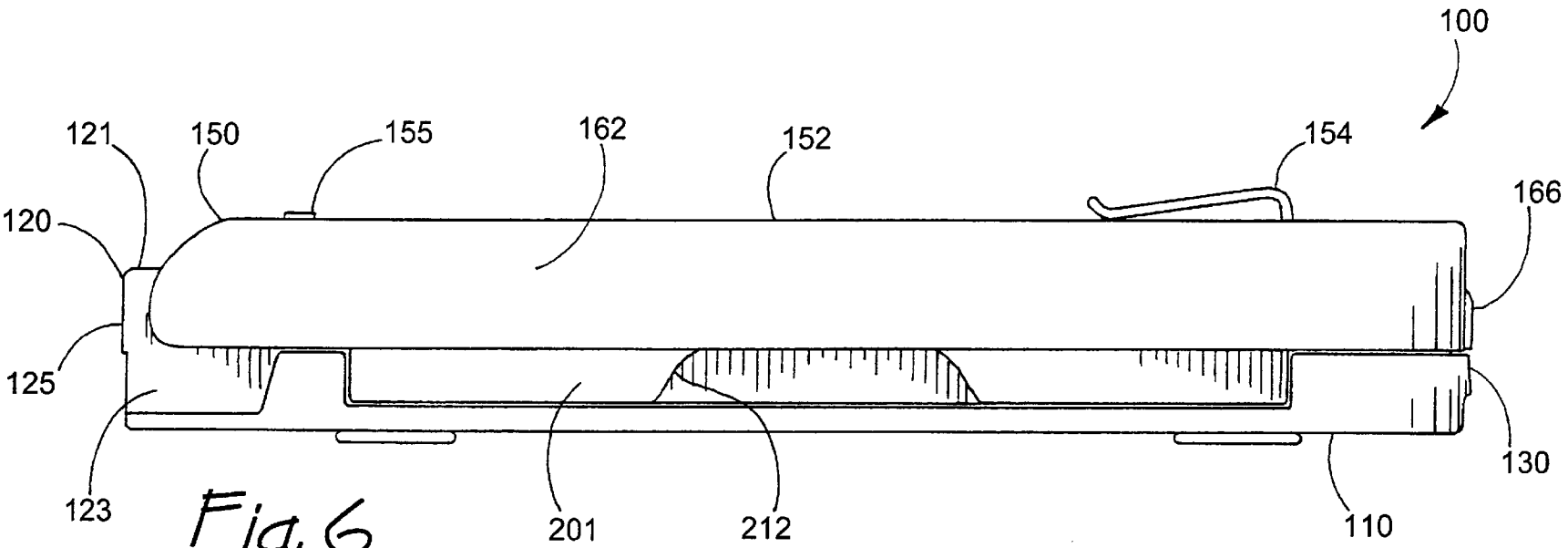
FIG. 6 is a right side elevational view thereof.

While the invention is susceptible to various modifications and alternative constructions, an illustrated embodiment thereof has been shown in the drawings and will be described in detail below. It should be understood, however, that there is no intention to limit the present invention to the disclosed structural forms. On the contrary, the intention is to cover all modifications, alternative constructions, and equivalents that fall within the scope and spirit of the invention as defined by the appended claims.

DETAILED DESCRIPTION OF THE ILLUSTRATED EMBODIMENT

Figure 8:
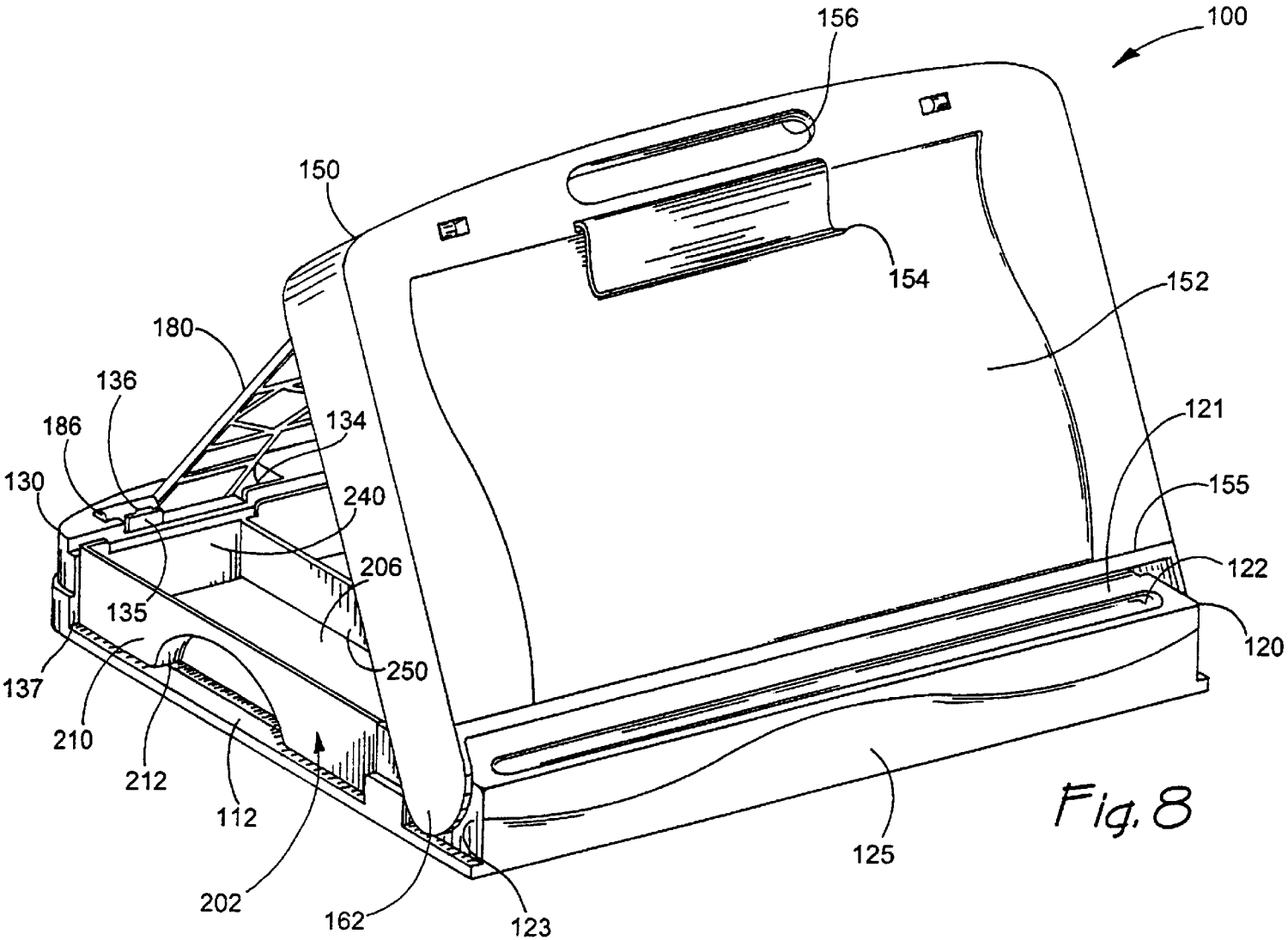
FIG. 8 is a front perspective view thereof, showing an upper housing portion of the easel in an inclined position.
Figure 9:
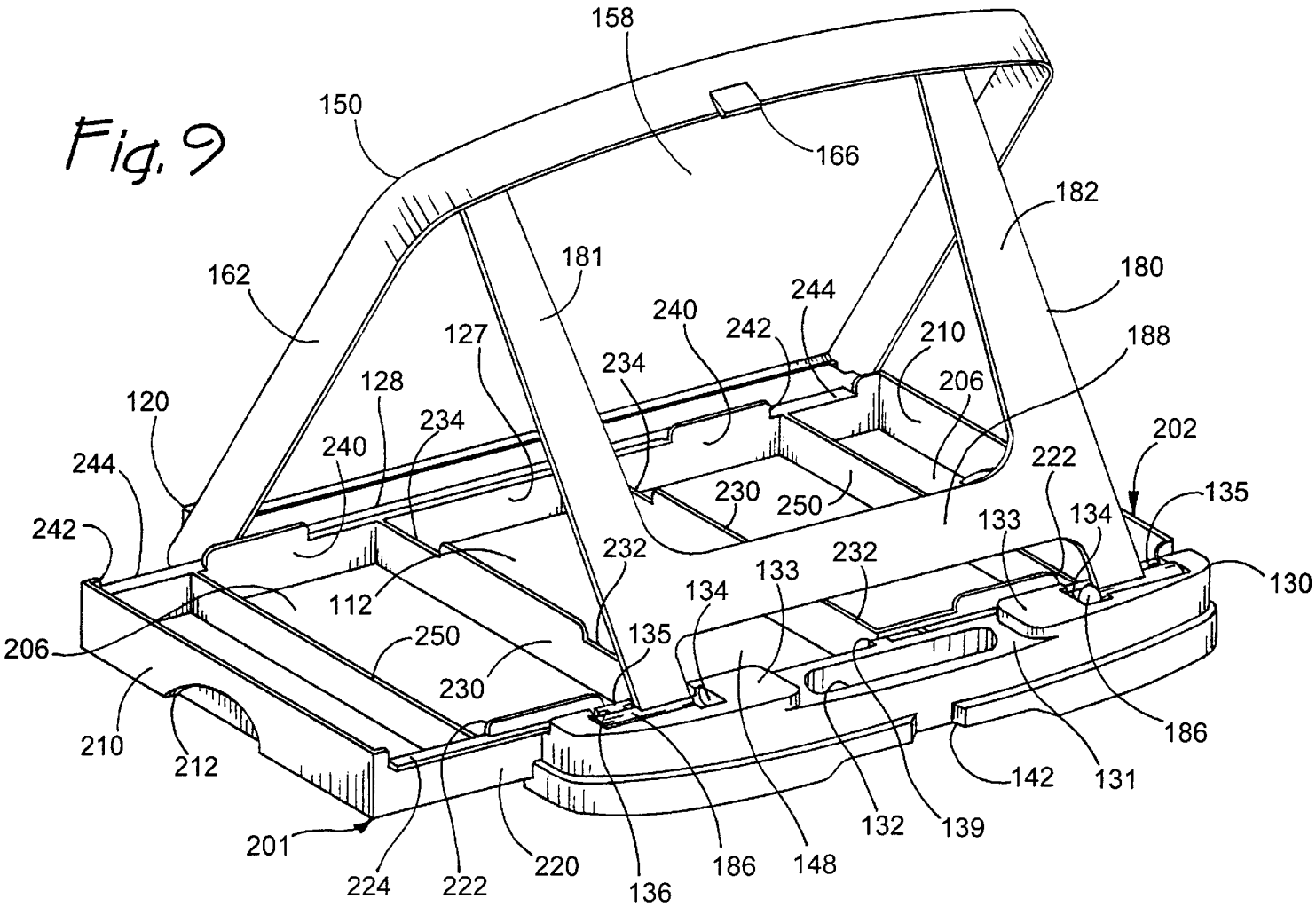
FIG. 9 is a rear perspective view thereof, showing the upper housing portion of the easel in the inclined position, one drawer of the easel in an open position, and the other drawer in a closed or shut position.
Figure 10:
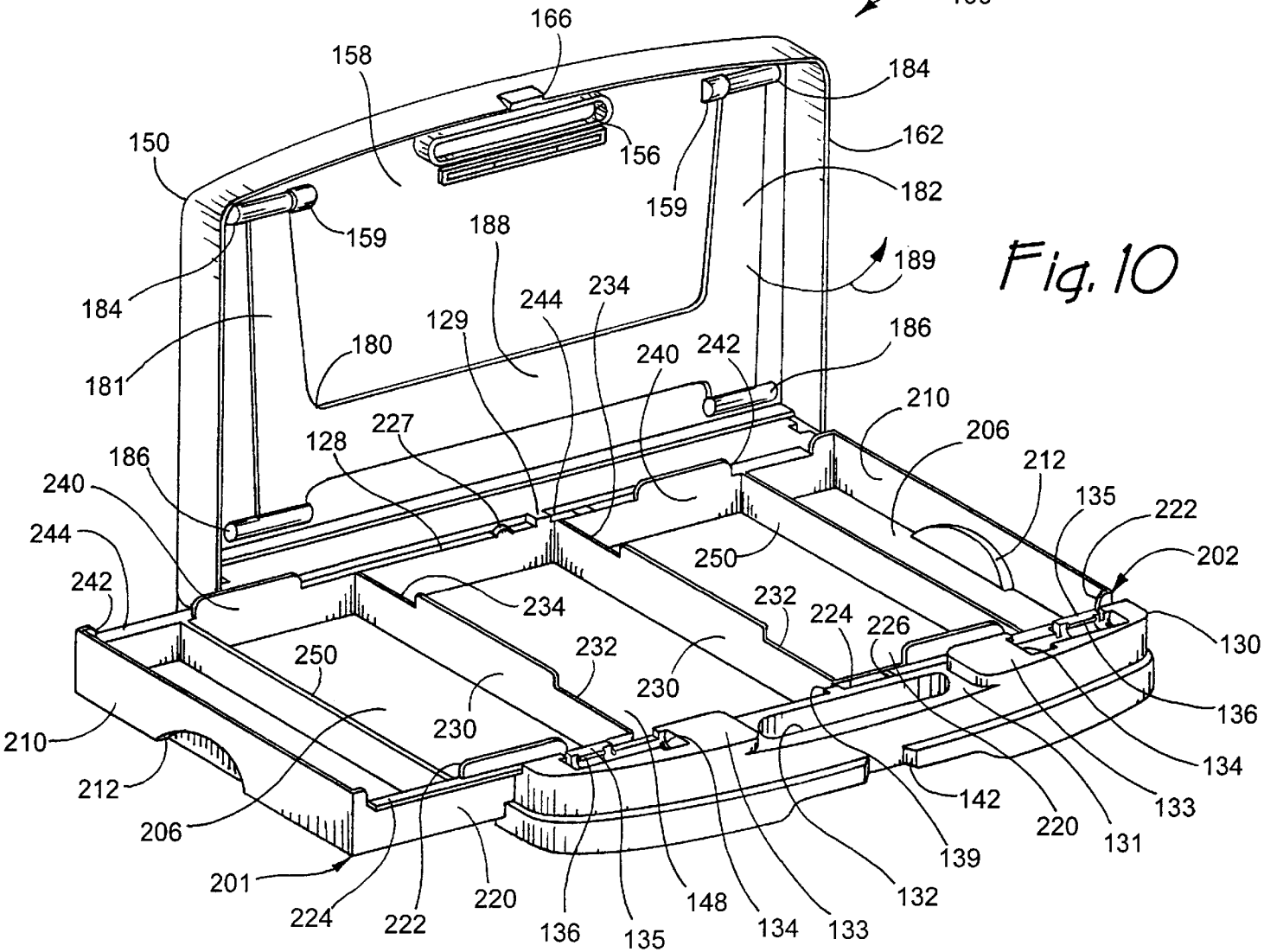
FIG. 10 is a rear perspective view similar to FIG. 9, but showing the upper housing portion of the easel in an upright position and the stand in a retracted position.

Referring now more particularly to the drawings, a multi-purpose easel constructed in accordance with the present invention is designated generally by reference numeral 100. The easel 100 includes a base or lower housing portion 110 which is adapted to be placed upon a surface, such as a table top, desk or the like, and a cover or upper housing portion 150 which is hingedly attached to the lower housing portion 110. The upper housing portion 150 can be moved between a multiplicity of operating positions including, for example, a closed position, as shown in FIGS. 1–7, 11, and 12, an upright position, as shown in FIG. 10, and an inclined position, as shown in FIGS. 8 and 9. The easel 100 further includes a stand 180 which supports the upper housing portion 150 in the inclined position. The easel 100 also includes a pair of drawers or tray members 201, 202 which are slidably installed within the lower housing portion 110 for selective inward and outward movement with respect thereto.

As best shown in FIGS. 8–12, the base or lower housing portion 110 of the easel 100 includes an interior surface 112, and opposed front and rear walls 120, 130 which project upwardly from the interior surface 112 to define a channel for the two drawers 201, 202. In the illustrated embodiment, the front wall 120 of the lower housing portion 110 includes a top surface 121, a pair of opposed side surfaces 123, an outer surface 125, and an inner surface 127 which borders the drawers 201, 202. In order to receive and accommodate graphical instruments, such as pencils, pens, crayons, chalk, paint brushes, and the like, the top surface 121 of the front wall 120 has a linear groove 122 formed therein, as shown, for example, in FIGS. 1, 2, 8. In addition, the side surfaces 123 of the front wall 122 have opposed holes 124 formed therein which receive cooperating peg members 164 formed on the upper housing portion 150, as shown, for example, in FIGS. 11 and 12, to pivotally attach the upper housing portion 150 to the lower housing portion 110.

The rear wall 130 of the lower housing portion 110 includes a top surface 131 with an oblong slot 132 formed centrally therethrough. In the illustrated embodiment, a pair of elevated or upstanding side portions 133 are formed on either side of the slot 132 at opposite ends of the rear wall 130. As best shown in FIG. 10, each upstanding side portion 133 has an indentation 134 formed therein. The rear wall 130 further includes an inner surface 137 which borders the drawers 201, 202, as shown, for example, in FIGS. 11 and 12.

Figure 7:
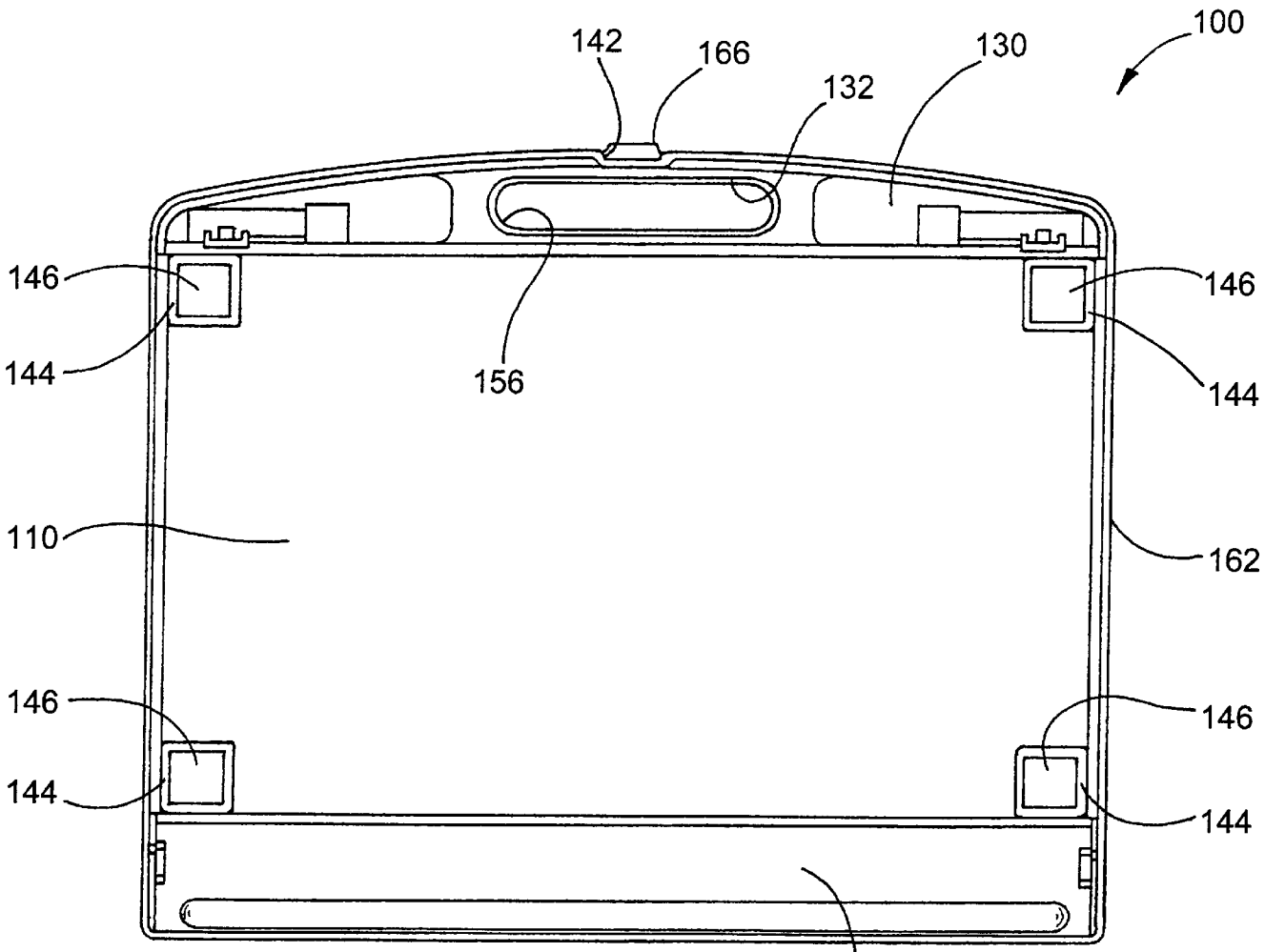
FIG. 7 is a bottom plan view thereof.

Referring to FIG. 7, the lower housing portion 110 has base portions 142. Resilient pads 144 are attached to the base portions 142. The resilient pads 142 prevent the easel from moving or slipping during use. In addition, the resilient pads 142 facilitate in preventing the base 110 from scratching the table top surface.

The cover or upper housing portion 150 of the easel 100 includes a generally flat and rectangular panel section 152. When the upper housing portion 150 is in the inclined position, as shown, for example, in FIGS. 8 and 9, the panel section 152 is sloped with respect to the interior surface 112 of the lower housing portion 110 and forms an inclined support surface upon which artwork and other material may be supported and displayed. In order to hold such material against the panel section 152, a spring clip member 154 is provided along a top portion of the panel section 152, as shown, for example, in FIG. 8, and a raised edge 155 is provided along a lower portion of the panel section 152.

In order to facilitate convenient handling of the easel 100, an oblong slot 156 is formed through the panel section 152 of the upper housing portion 150 at an outboard position with respect to the spring clip member 154. When the upper housing portion 150 is in the closed position, this slot 156 is substantially aligned with the oblong slot 132 formed through the rear wall 130 of the lower housing portion 110, as shown, for example, in FIGS. 7 and 11. Each slot 132, 156 is sized and shaped to receive human fingers in a comfortable manner.

Figure 11:
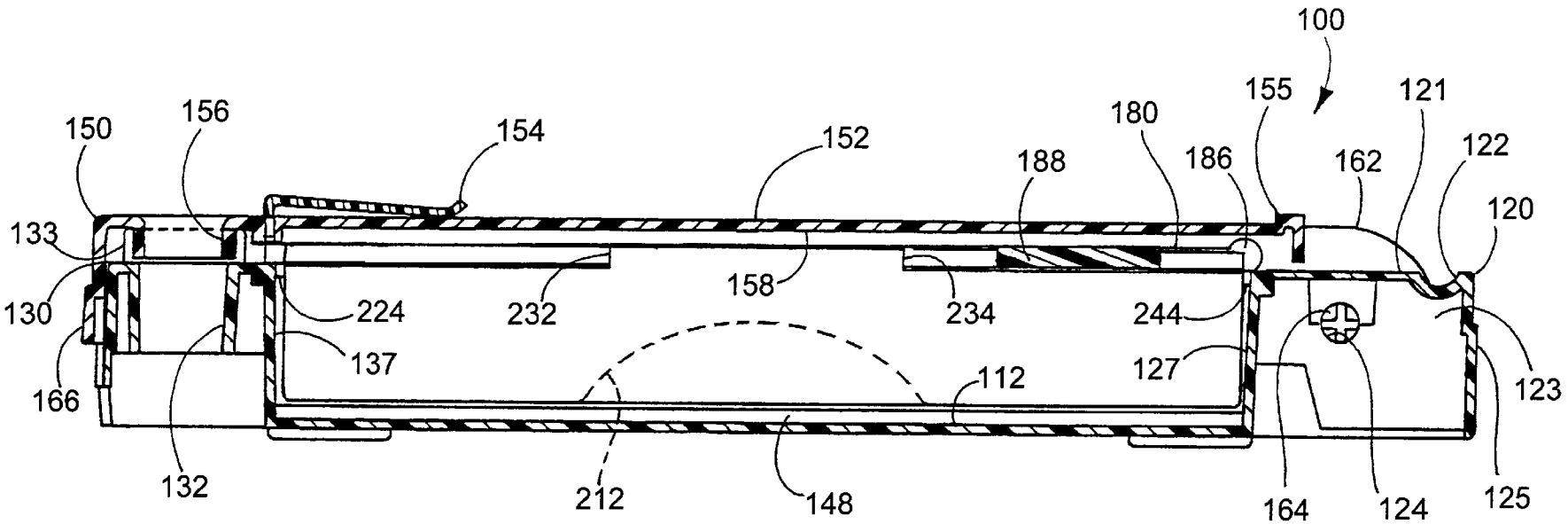
FIG. 11 is a cross-sectional view, taken along line 11—11 of FIG. 2.
Figure 12:
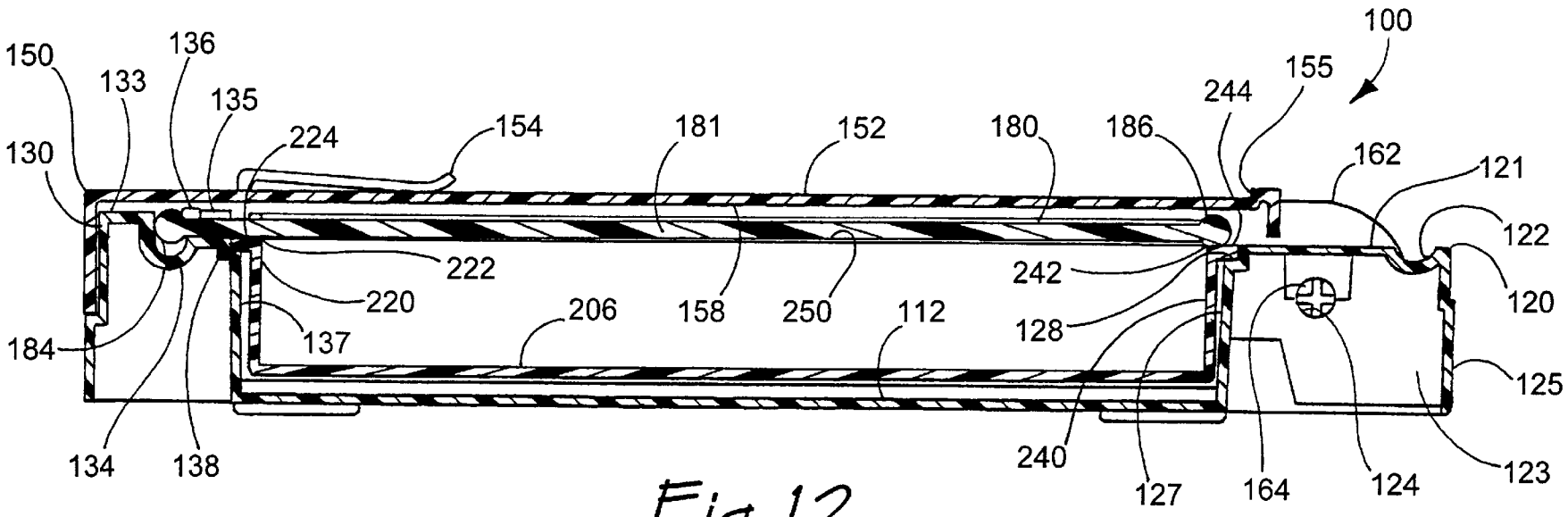
FIG. 12 is a cross-sectional view, taken along line 12—12 of FIG. 2.

The upper housing portion 150 of the easel 100 also includes a peripheral side wall 162 which selectively obstructs outward movement of the drawers 201, 202. As best shown in FIGS. 9 and 10, the peripheral side wall 162 is formed along three sides of the panel section 152 and is substantially perpendicular with respect thereto. When the two drawers 201, 202 are inboard of the peripheral side wall 162 and the upper housing portion 150 is in the closed position, as shown, for example, in FIGS. 1–7, the peripheral side wall 162 obstructs outward movement of the drawers 201, 202. In this condition, the easel 100 also serves as a portable carrying case. As shown in FIGS. 11 and 12, the peripheral side wall 162 also includes the opposed peg members 164 which are received by the holes 124 formed in the side surfaces 123 of the front wall 120 to pivotally attach the upper housing portion 150 to the front wall 120 of the lower housing portion 110.

In keeping with an important aspect of the present invention, the stand 180 supports the upper housing portion 150 in the inclined position. In the illustrated embodiment, the stand 180 is generally flat or planar in construction, and includes a pair of spaced apart side members 181, 182 with a transverse support member 188 therebetween. As best shown in FIG. 10, the side members 181, 182 of the stand 180 have first lug portions 184 at their proximal ends, and similarly configured second lug portions 186 at their distal ends. The first lug portions 184 are hingedly attached to the panel section 152 of the upper housing portion 150, and the second lug portions 186 are unattached or free. More specifically, the first lug portions 184 of the stand 180 pivotally engage slotted receiving members 159 formed on an interior surface 158 of the panel section 152 which enables the stand 180 to swivel in a generally arcuate manner with respect to the upper housing portion 150, as indicated, for example, by reference numeral 189 in FIG. 10. While other configurations are permissible and would fall within the scope and spirit of the present invention, the first and second lug portions 184, 186 of the illustrated embodiment have generally cylindrical configurations.

In usage, the second lug portions 186 of the stand 180 are received by the indentations 134 formed in the upstanding side portions 133 of the rear wall 130 to support the upper housing portion 150 in the inclined position, as shown, for example, in FIGS. 8 and 9. On account of this construction, the upper housing portion 150 of the easel 100 may be easily set-up in the inclined position without the use of tools or other equipment. In fact, the upper housing portion 150 may be manually placed into the inclined position by following a few simple actions. First, the upper housing portion 150 is pivoted upwardly toward the upright position, as shown, for example, in FIG. 10. In the upright position, the panel section 152 of the upper housing portion 150 is substantially perpendicular to the interior surface 112 of the lower housing portion 110. Next, the stand 180 is pivoted outwardly, as indicated by reference numeral 189, with respect to the panel section 152 of the upper housing portion 150 until the stand 180 forms an acute angle with the panel section 152. Thereafter, the upper housing portion 150 and the stand 180 are collectively lowered as a unit until the second lug portions 186 of the stand 180 are received within the indentations 134 formed in the upstanding side portions 133 of the rear wall 130, as shown, for example, in FIGS. 8 and 9.

In order to provide convenient snap-fit interfaces between the indentations 134 of the rear wall 130 and the lug portions 184, 186 of the stand 180, each indentation 134 includes an adaptable holding segment 135 at an interior adjacent side thereof. In the illustrated embodiment, these adaptable holding segments 135 comprise relatively thin panels of material that project upwardly from the upstanding side portions 133 of the rear wall 130, as shown, for example, in FIGS. 10 and 12. These adaptable holding segments 135 also have lip portions 136 at their distal ends which interact with the lug portions 184, 186 of the stand 180 in a snap-fit manner to hold the lug portions 184, 186 within the indentations 134 of the rear wall 130.

For example, when the upper housing portion 150 is in the inclined position, the second lug portions 186 of the stand 180 are received by the indentations 134 of the rear wall 130. Under ordinary conditions, the second lug portions 186 of the stand 180 rest upon the lip portions 136 of the adaptable holding segments 135. When a sufficient inward force is applied to the stand 180, however, the adaptable holding segments 135 flex slightly out of the way to permit the second lug portions 186 to move downwardly past the lip portions 136 for more complete entry into the indentations 134. In addition, once the second lug portions 186 have fully entered the indentations 134, the adaptable holding segments 135 flex back to their original position to releasably capture the second lug portions 186 beneath the lip portions 136 of the adaptable holding segments 135, as shown, for example, in FIGS. 8 and 9. In this way, the adaptable holding segments 135 and their lip portions 136 provide convenient snap-fit interfaces between the second lug portions 186 of the stand 180 and the indentations 134 formed in the rear wall 130 of the lower housing portion 110 which holds the upper housing portion 150 in the inclined position. Of course, when a sufficient upward force is applied to the stand 180 and/or the upper housing portion 150, the second lug portions 186 become dislodged from the indentations 134 which releases the upper housing portion 150 from the inclined position.

Similarly, when the upper housing portion 150 is in the closed position, the first lug portions 184 of the stand 180 are received by the indentations 134 formed in the rear wall 130 of the lower housing portion 110 in a snap-fit manner, as shown, for example, in FIG. 12. As described more fully above in connection with the second lug portions 186 of the stand 180, the first lug portions 184 are releasably captured beneath the lip portions 136 of the adaptable holding segments 135. In this way, the adaptable holding segments 135 and their lip portions 136 provide convenient snap-fit interfaces between the first lug portions 184 of the stand 180 and the indentations 134 formed in the upstanding side portions 133 of the rear wall 130 which holds the upper housing portion 150 in the closed position. Of course, when a sufficient upward force is applied to the upper housing portion 150, the first lug portions 184 become dislodged from the indentations 134 which releases the upper housing portion 150 from the closed position and opens the easel 100. In order to facilitate such opening, a notch 142 is formed in an outer surface of the rear wall 130, and an aligned protrusion 166 is formed on the peripheral side wall 162 of the upper housing portion 150, as shown, for example, in FIGS. 5, 7, 9, and 10.

In keeping with another important aspect of the present invention, the two drawers or tray members 201, 202 permit various supplies, such as pens, pencils, crayons, chalk, paint, paint brushes, paper, and the like, to be conveniently stored within the easel 100. In addition, when these drawers 201, 202 are shut and the upper housing portion 140 is in the closed position, as shown, for example, in FIGS. 1–7, 11, and 12, the easel 100 forms a portable carrying case wherein such supplies may be transported in a convenient manner.

In addition, the easel has a storage area 144 for paper under the drawers 201, 202. Referring to FIGS. 9–11, the paper storage area 144 is located between the drawers and the interior surface 112. When the user wishes to store unused or used paper, the user opens one or both of the drawers 201, 202 and places the paper in the storage area 144. After placing the paper in the storage area 144, the user then closes the drawer or drawers.

As shown in FIG. 10, each drawer or tray member 201, 202 comprises a substantially flat and generally rectangular bottom portion 206, and four connected side wall portions 210, 220, 230, 240 standing upwardly therefrom along respective edges. In addition, each drawer 201, 202 further includes a center wall portion 250 which extends between the second and fourth side wall portions 220, 240 to partition the drawers 201, 202 into two distinct storage compartments. Each drawer 201, 202 also includes a pair of opposed platforms or ledges 224, 244 which project outwardly from the second and fourth side wall portions 220, 240, respectively. As best shown in FIGS. 10 and 12, one ledge 224 slidably engages a longitudinal groove 138 formed along the intersection of the top and inner surfaces 131, 137 of the rear wall 130, and the other ledge 244 slidably engages a longitudinal groove 128 formed along the intersection of the top and inner surfaces 121, 127 of the front wall 120.

In order to prevent the drawers 201, 202 from sliding too far inwardly, a pair of opposed internal stop members 129, 139 are formed on the front and rear walls 120, 130 of the lower housing portion 110 for selective engagement with the ledges 224, 244 of the drawers 201, 202. In the illustrated embodiment, a first internal stop member 129 is formed centrally along the longitudinal groove 128 formed in the front wall 120, as shown, for example, in FIG. 10, and a second internal stop member 139 is formed centrally along the longitudinal groove 138 formed in the rear wall 130.

As best shown in FIGS. 9 and 10, the two drawers 201, 202 are slidably arranged within the channel of the lower housing portion 110 in opposed, mirror-image, aligned relationship with respect to each other. As such, the two drawers 201, 202 are independently movable between shut and open positions from opposite sides of the lower housing portion 110. In the shut position, the drawers 201, 202 are positioned entirely upon the interior surface 112 of the lower housing portion 110, as exemplified by drawer 202 in FIGS. 9 and 10. In addition, the opposed ledges 224, 244 of drawer 202 abut the internal stop members 129, 139 formed on the front and rear walls 120, 130 of lower housing portion 110. Also, the first side wall portion 210 of drawer 202 is positioned inboard of the peripheral side wall 162 of the upper housing portion 150.

In the open position, conversely, the drawers 201, 202 are positioned at least partially off of the interior surface 112 of the lower housing portion 110, as exemplified by drawer 201 in FIGS. 9 and 10. In addition, the opposed ledges 224, 244 of drawer 201 are spaced apart from the internal stop members 129, 139 formed on the front and rear walls 120, 130 of lower housing portion 110. Also, the first side wall portion 210 of drawer 201 is positioned outboard of the peripheral side wall 162 of the upper housing portion 150.

On account of this construction, each drawer 201, 202 may be moved between the shut and open positions to retrieve supplies therefrom without obstructing the area directly in front of and proximate to the front wall 120 of the lower housing portion 110. Of course, when either of the two drawers 201, 202 are in the open position, the upper housing portion 150 is blocked from moving toward the closed position. When both drawers 201, 202 are in the shut position, however, the upper housing portion 150 may be moved between the upright and closed positions in an unimpeded manner.

In order to facilitate convenient inward and outward movement of the drawers 201, 202 between the open and shut positions, each drawer 201, 202 includes an indented section 212 formed along a lower edge of the first side wall portion 210. While other configurations are permissible and would certainly fall within the scope and spirit of the present invention, the indented sections 212 of the illustrated embodiment have generally arcuate configurations.

As shown in FIGS. 9 and 10, a pair of opposed slots 226 are formed in the two ledges 224, 244 of each drawer 201, 202. When the drawers 201, 202 are in the shut position, these slots 226 cooperatively engage small ridges 227 formed along the longitudinal grooves 128, 138 of the front and rear walls 120, 130, as exemplified by drawer 202. During such engagement, drawer 202 is held in the shut position until a sufficient outward pulling force is applied thereto. In this way, the slots 226 of the drawers 201, 202 interact with the ridges 227 formed along the longitudinal grooves 128, 138 of the of the front and rear walls 120, 130 to provide a releasable retaining feature between the channel of the lower housing portion 110 and each drawer 201, 202.

The drawers 201, 202 are also reversible in their positioning with respect to the lower housing portion 110 of the easel 100. By way of example, the two drawers 201, 202 shown in FIGS. 9 and 10 may be reversed in their respective positions by extracting both drawers 201, 202 from the channel of the lower housing portion 110, and then reinstalling each drawer 201, 202 such that drawer 201 occupies the position formerly occupied by drawer 202, and drawer 202 occupies the position formerly occupied by drawer 201.

When the drawers 201, 202 are in the shut position and the upper housing portion 150 is in the closed position, the panel section 152 of the upper housing portion 150 is substantially parallel to the interior surface 112 of the lower housing portion 110, as shown, for example, in FIGS. 11 and 12, and the stand 180 is positioned between the panel section 152 and the two drawers 201, 202. More specifically, the transverse support member 188 of the stand 180 is received by one of two generally rectangular notches 232, 234 formed in the third side wall portion 230 of each drawer 201, 202, as shown, for example, in FIG. 11. Of course, two notches 232, 234 are provided to accommodate the reversible nature of the drawers 201, 202. Also, the side members 181, 182 of the stand 180 are positioned between the panel section 152 of the upper housing portion 150 and the center wall portion 250 of each drawer 201, 202, as shown, for example, in FIG. 12. In addition, the first lug portions 184 of the stand 180, together with the slotted receiving members 159 formed on the interior surface 158 of panel section 152, are received by the indentations 134 formed in the upstanding side portions 133 of the rear wall 130 of the lower housing portion 110. Moreover, the second lug portions 186 of the stand 180 are received by generally rectangular notches 242 formed in the fourth side wall portion 240 of each drawer 201, 202. Finally, the side members 181, 182 are received by generally rectangular notches 222 formed in the second side wall portion 220 of each drawer 201, 202.

Although other materials may be utilized and would certainly fall within the scope and spirit of the present invention, those skilled in the art will appreciate that the first housing portion 110, the second housing portion 150, the stand 180, and the drawers 201, 202 of the inventive easel 100 may be formed of durable plastic material, such as polystyrene, ABS, or the like.

While the present invention has been disclosed in connection with an illustrated embodiment, it will be understood, of course, that there is no intention to limit the invention to the disclosed structural forms. On the contrary, the intention is to cover to cover all modifications, alternative constructions, and equivalents that fall within the scope and spirit of the present invention as defined by the following claims.

What is claimed is:

1. A multi-purpose easel comprising:

a lower housing portion having opposed walls and a generally flat interior surface therebetween, the opposed walls having at least one indentation formed therein;

an upper housing portion having a generally flat panel section, the upper housing portion being hingedly attached to one of the opposed side walls of the lower housing portion for movement between a closed position, wherein the panel section is substantially parallel to the interior surface of the lower housing portion and the upper and lower housing portions form a carrying case in which supplies may be stored and transported, and an inclined position, wherein the panel section is inclined with respect to the interior surface of the lower housing portion to form an inclined support surface upon which material may be supported and displayed;

a stand hingedly attached to the panel section of the upper housing portion at one end thereof and unattached at an opposite end thereof, the stand having at least one lug portion at its opposite end which is received by said at least one indentation formed in the opposed walls of the lower housing portion to support the stand in the inclined position; and a pair of drawers slidably arranged upon the interior surface and between the opposed side walls of the lower housing portion in opposed, mirror-image, aligned relationship with respect to each other and independently movable between open and shut positions from opposite sides of the lower housing portion.

2. A multi-purpose table top easel comprising:

a lower housing portion;

an upper housing portion hingedly attached to the lower housing portion for movement between a multiplicity of operating positions including a closed position and an inclined position;

a first drawer slidably installed within the lower housing portion for selective inward and outward movement with respect thereto;

the lower housing portion includes a generally flat interior surface upon which the first drawer is slidably installed, and the upper housing portion includes a generally flat panel section; and the upper housing portion includes a peripheral side wall which obstructs outward movement of the first drawer when the first drawer is shut and the upper housing portion is in the closed position.

3. The invention set forth in claim 2, wherein the peripheral side wall of the upper housing portion is provided along three sides of the panel section.

4. A multi-purpose table top easel comprising:

a lower housing portion;

an upper housing portion hingedly attached to the lower housing portion for movement between a multiplicity of operating positions including a closed position and an inclined position;

a first drawer slidably installed within the lower housing portion for selective inward and outward movement with respect thereto;

the lower housing portion includes a generally flat interior surface upon which the first drawer is slidably installed, and the upper housing portion includes a generally flat panel section;

the lower housing portion includes opposed front and rear walls which project upwardly from an interior surface thereof; and the front wall of the lower housing portion includes a groove which is adapted to receive graphical instruments therein.

5. A multi-purpose table top easel comprising:

a lower housing portion;

an upper housing portion hingedly attached to the lower housing portion for movement between a multiplicity of operating positions including a closed position and an inclined position;

a first drawer slidably installed within the lower housing portion for selective inward and outward movement with respect thereto; and the first drawer moves inwardly and outwardly from a side of the lower housing portion.

6. A multi-purpose table top easel comprising:

a lower housing portion;

an upper housing portion hingedly attached to the lower housing portion for movement between a multiplicity of operating positions including a closed position and an inclined position;

a first drawer slidably installed within the lower housing portion for selective inward and outward movement with respect thereto; and the first drawer is partitioned into more than one storage compartment.

7. A multi-purpose table top easel comprising:

a lower housing portion;

an upper housing portion hingedly attached to the lower housing portion for movement between a multiplicity of operating positions including a closed position and an inclined position;

a first drawer slidably installed within the lower housing portion for selective inward and outward movement with respect thereto; and the first drawer includes a generally flat and generally rectangular bottom portion and four connected side wall portions standing upwardly therefrom.

8. The invention set forth in claim 7, wherein one of the four connected side wall portions of the first drawer includes an indented section to facilitate inward and outward movement of said the first drawer.

9. A multi-purpose table top easel comprising:

a lower housing portion;

an upper housing portion hingedly attached to the lower housing portion for movement between a multiplicity of operating positions including a closed position and an inclined position;

a first drawer slidably installed within the lower housing portion for selective inward and outward movement with respect thereto; and a second drawer, wherein the first drawer and the second drawer are arranged in opposed, mirror-image, aligned relationship with respect to each other and independently movable between open and shut positions from opposite sides of the lower housing portion.

10. The invention set forth in claim 9, wherein each drawer includes at least one ledge which abuts an internal stop member formed on the lower housing portion when in the shut position and is spaced apart therefrom when in the open position.

11. A multi-purpose table top easel comprising:

a lower housing portion;

an upper housing portion hingedly attached to the lower housing portion for movement between a multiplicity of operating positions including a closed position and an inclined position;

a first drawer slidably installed within the lower housing portion for selective inward and outward movement with respect thereto;

a stand for supporting the upper housing portion in the inclined position, the stand being hingedly attached to the upper housing portion at one end thereof and being unattached at an opposite end thereof; and the stand includes a pair of spaced apart side members and a transverse support member therebetween.

12. The invention set forth in claim 11, wherein the side members of the stand have first lug portions at their proximal ends which are hingedly attached to an interior surface of the upper housing portion, and second lug portions at their distal ends which are received by cooperating indentations formed in the lower housing portion to support the upper housing portion in the inclined position.

13. The invention set forth in claim 12, wherein the indentations formed in the lower housing portion are formed in a front wall of the lower housing portion.

14. The invention set forth in claim 11, wherein the indentations formed in the lower housing portion have adaptable holding segments which interact with the second lug portions of the stand to provide snap-fit interfaces therebetween when the upper housing portion is in the inclined position.

15. The invention set forth in claim 11, wherein the first lug portions of the stand are received by the indentations formed in the lower housing portion when the upper housing portion is in the closed position.

16. The invention set forth in claim 15, wherein the indentations formed in the lower housing portion have adaptable holding segments which interact with the first lug portions of the stand to provide snap-fit interfaces therebetween when the upper housing portion is in the closed position.

17. The invention set forth in claim 11, wherein the transverse support member of the stand is received by a cooperating notch formed in the first drawer when the upper housing portion is in the closed position.

18. A multi-purpose table top easel comprising:

a lower housing portion;

an upper housing portion hingedly attached to the lower housing portion for movement between a multiplicity of operating positions including a closed position and an inclined position;

a first drawer slidably installed within the lower housing portion for selective inward and outward movement with respect thereto; and a stand, the stand includes at least one lug portion which is received by at least one cooperating indentation formed in the lower housing portion to support the upper housing portion in the inclined position.

* * * * *

UNITED STATES PATENT AND TRADEMARK OFFICE

CERTIFICATE OF CORRECTION

PATENT NO. : 6,045,108
DATED : April 4, 2000
INVENTOR(S) : Cziraky

It is certified that error appears in the above-identified patent and that said Letters Patent is hereby corrected as shown below:

ON THE TITLE PAGE

Item [54] and Col. 1, line 1 and 2

"Inclined Adjustable Easel With Slidably Drawer" should be --Easel--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*